US007866854B2

(12) United States Patent
Orellana et al.

(10) Patent No.: US 7,866,854 B2
(45) Date of Patent: Jan. 11, 2011

(54) OUTDOOR LIGHTING FIXTURE

(75) Inventors: William Orellana, Palmdale, CA (US); Angel Orellana, Los Angeles, CA (US); Henry Avila, Palmdale, CA (US)

(73) Assignee: U.S. Pole Company, Inc., Palmdale, CA (US)

( * ) Notice: Subject to any disclaimer, the term of this patent is extended or adjusted under 35 U.S.C. 154(b) by 234 days.

(21) Appl. No.: 12/113,123

(22) Filed: Apr. 30, 2008

(65) Prior Publication Data

US 2009/0034265 A1 Feb. 5, 2009

Related U.S. Application Data

(60) Provisional application No. 60/916,235, filed on May 4, 2007.

(51) Int. Cl.
*F21V 7/00* (2006.01)

(52) U.S. Cl. ..... 362/310; 362/311.01; 362/346; 362/186

(58) Field of Classification Search ..... 362/1, 362/310, 311.01, 311.14, 346, 153.1, 186, 362/268, 277

See application file for complete search history.

(56) References Cited

U.S. PATENT DOCUMENTS 3,530,287 A * 9/1970 Husby ..... 362/645
4,028,541 A * 6/1977 Franklin ..... 362/307
4,523,693 A * 6/1985 Bilson ..... 220/836
5,829,866 A * 11/1998 Stegeman ..... 362/655

* cited by examiner

*Primary Examiner*—Sandra L O'Shea
*Assistant Examiner*—Danielle Allen
(74) *Attorney, Agent, or Firm*—Christie, Parker & Hale, LLP

(57) ABSTRACT

A housing has a component storage cavity and an open bottom. A door covers and uncovers the open bottom. The door preferably has a latch that can be released with one hand. A window in the door transmits light from the housing. A partition divides the component storage cavity into a lamp section and a control component section. There is an opening through the partition. A removable control component mounting plate is dimensioned to cover the opening and thus become part of the control component section. A removable lamp reflector lies inside the housing behind the window. The mounting plate and reflector preferably each have a latch that can be released with one hand.

20 Claims, 9 Drawing Sheets

OUTDOOR LIGHTING FIXTURE

CROSS-REFERENCE TO RELATED APPLICATION(S)

This application claims priority to and the benefit of U.S. Provisional Application No. 60/916,235, filed on May 4, 2007, the entire contents of which are incorporated herein by reference. This application also claims priority to U.S. Design application Ser. No. 29/286,902 filed May 21, 2007 entitled Lighting Fixture, now U.S. Design Pat. No. D570516, which is incorporated herein by reference.

BACKGROUND OF THE INVENTION

This application relates to lighting fixtures, and more particularly, to outdoor lighting fixtures designed for ease of servicing.

Outdoor lighting fixtures are often mounted on high poles. This creates a problem when it becomes time to service the fixture, such as replacing a lamp or ballast. The maintenance person servicing the fixture must climb a ladder or other lift mechanism and normally use a tool and two hands to complete the task, lessening his ability to stabilize himself during the operation.

SUMMARY OF THE INVENTION

The invention is designed to facilitate the servicing of an outdoor lighting fixture without tools, preferably with one hand. A housing has a component storage cavity and an open bottom. A door covers and uncovers the open bottom. The door preferably has a latch that can be released with one hand. A window in the door transmits light from the housing. A partition divides the component storage cavity into a lamp section and a control component section. There is an opening through the partition. A removable control component mounting plate is dimensioned to cover the opening and thus become part of the control component section. A removable lamp reflector lies inside the housing behind the window. The mounting plate and reflector preferably each have a latch that can be released with one hand.

DETAILED DESCRIPTION OF AN EXEMPLARY EMBODIMENT OF THE INVENTION

Figure 1:
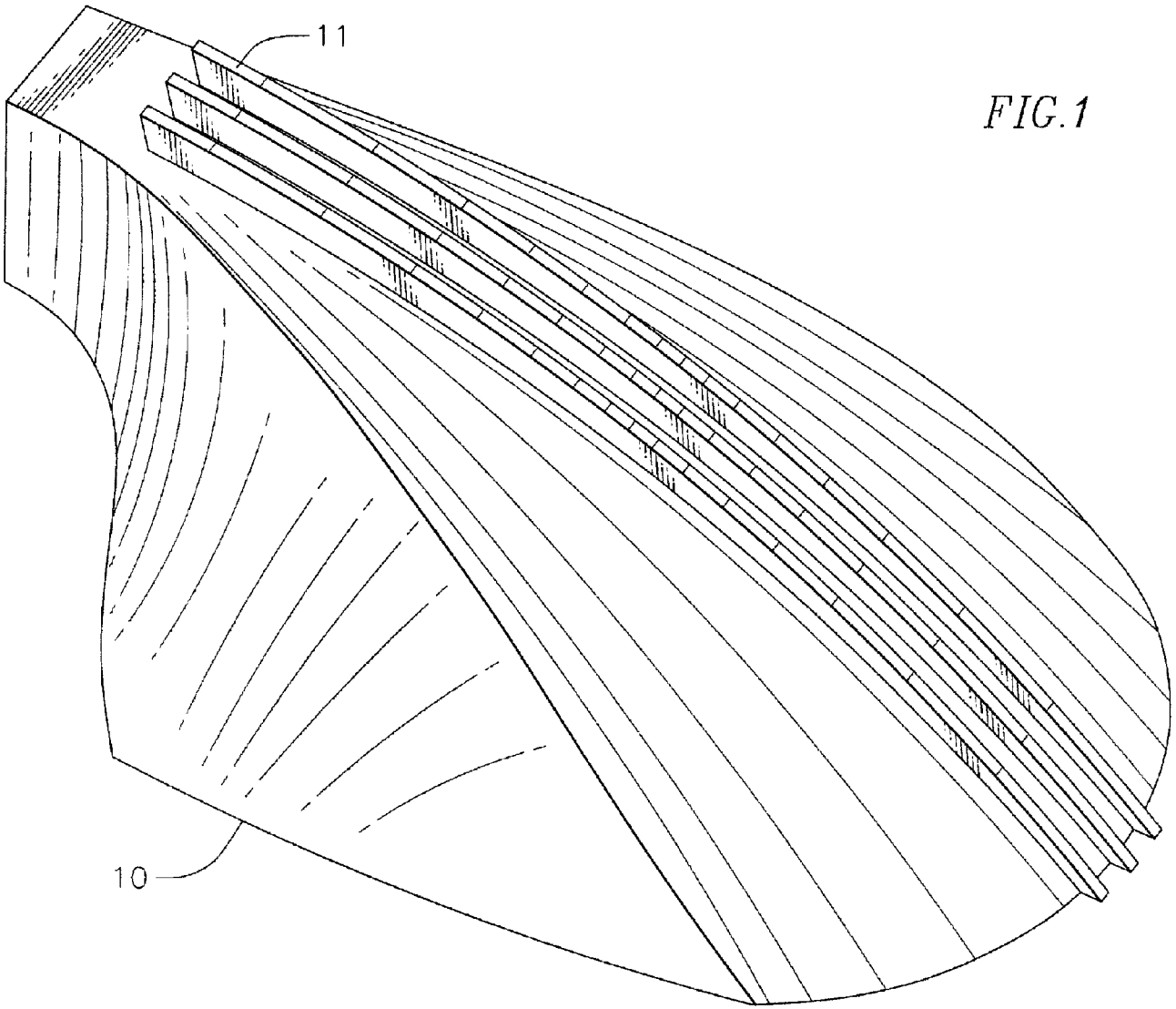
FIG. 1 is a perspective view of a lighting fixture that incorporates the principles of the invention.
Figure 2:
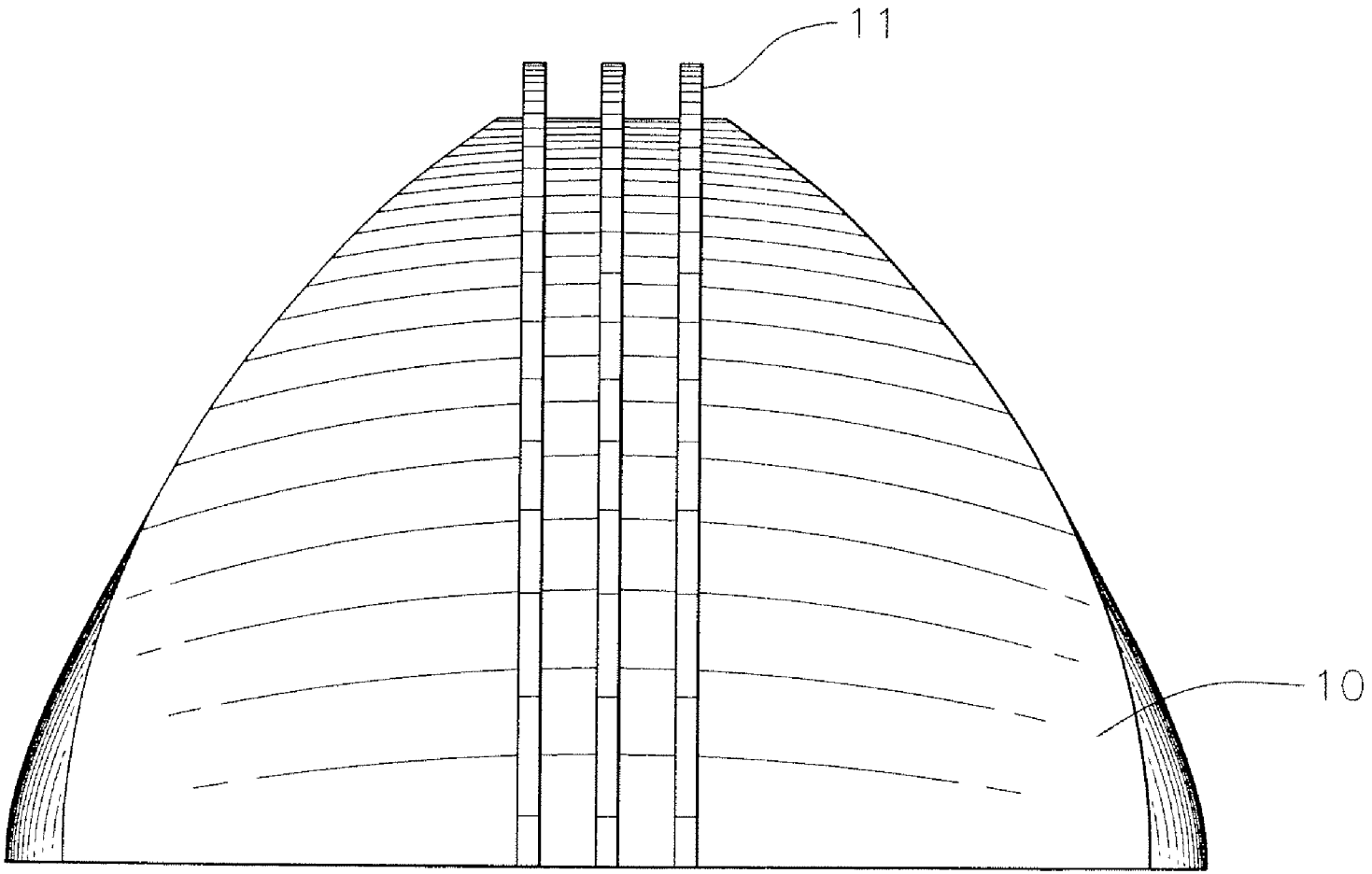
FIG. 2 is a front elevation view of the lighting fixture.

As shown in FIGS. 1 and 2, a lighting fixture that is primarily for outdoor use has a housing 10 and heat dissipating fins 11.

Figure 3A:
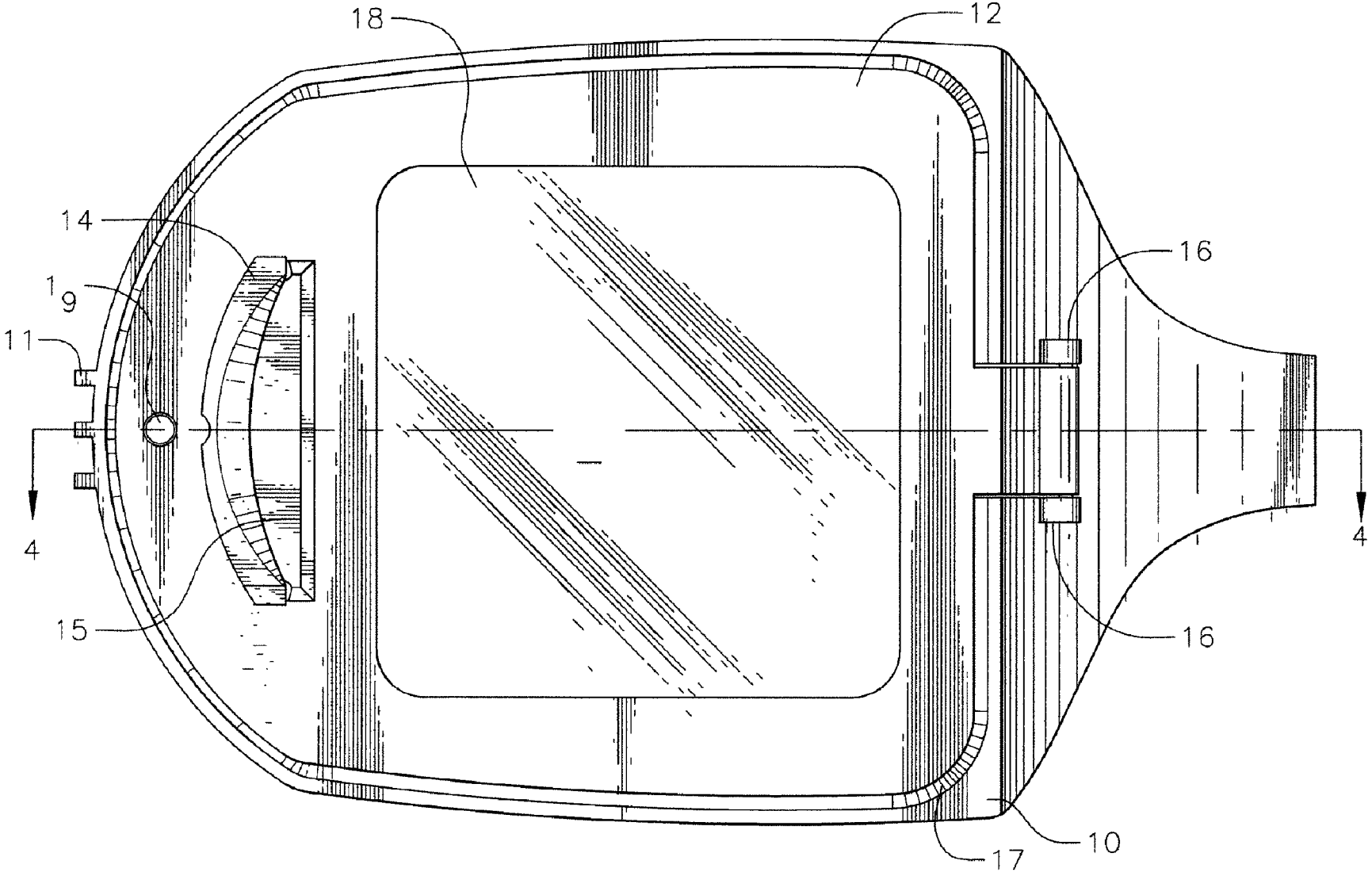
FIG. 3A is a bottom plane view of the lighting fixture.

As shown in FIG. 3A, a door 12 has a hand grip 14 for opening and closing the door 12, an indentation 15 that together with the hand grip 14 provides a space for the user's fingers, and a door hinge 16. Door 12 has a window 18 through which light is transmitted from a lamp inside the fixture to the area being illuminated outside the fixture.

Figure 3B:
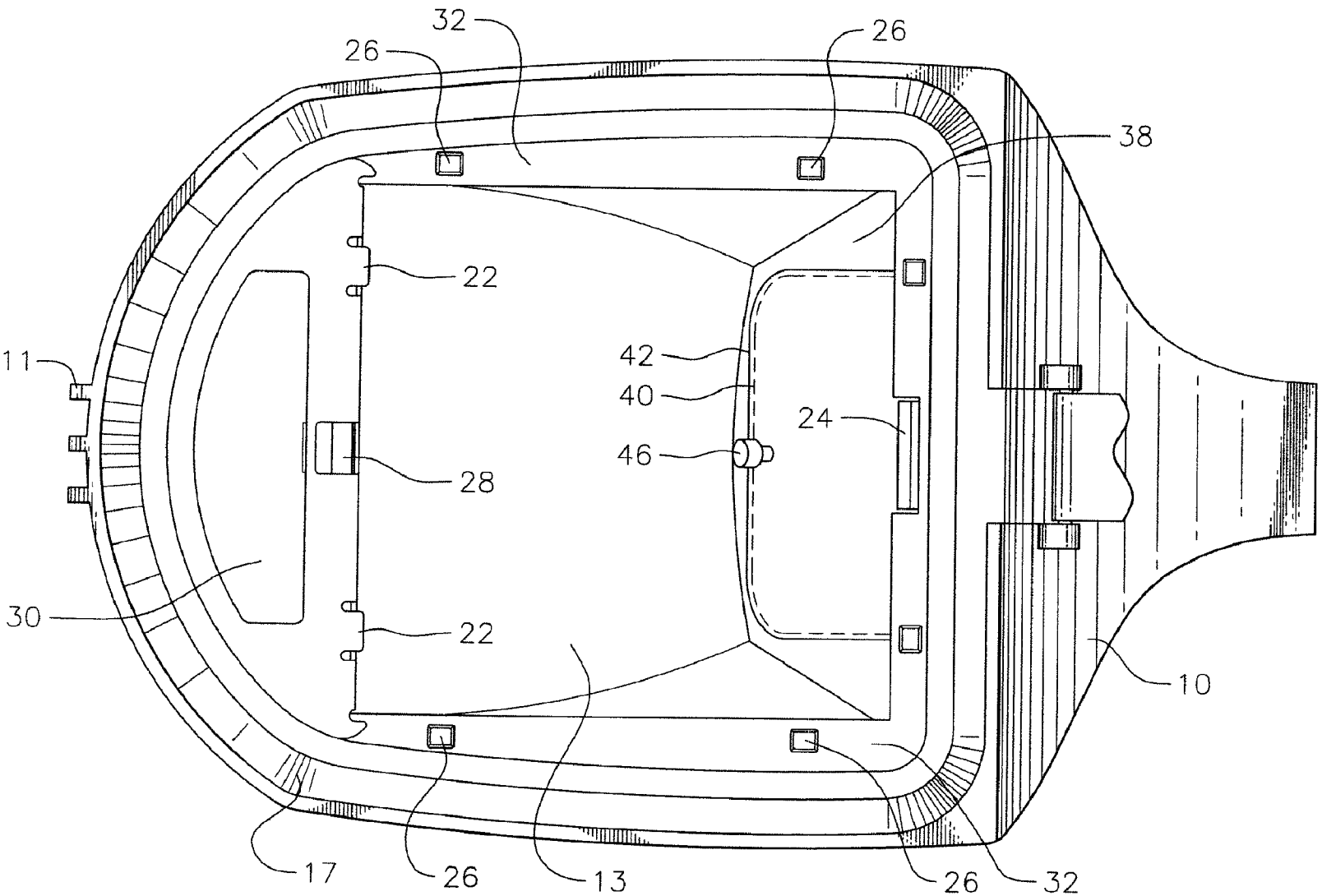
FIG. 3B is a bottom plane view of the lighting fixture without the door or lamp reflector.

In FIG. 3B, the door 12 and a lamp reflector 20 (FIG. 4) have been removed to expose the interior of housing 10. A ballast etc. is coupled to reflector 20 by a pair of quick disconnect connectors. Reflector 20 when installed is retained by tabs 22 and a spring clip 24. Protrusions 26 serve to guide reflector 20 during installation and hold reflector 20 in position laterally after installation. A roller latch 28 engages a spring latch keeper 31 (FIG. 6) mounted on door 12 when closed. Indentation 15 in door 12 fits into an opening 30 in housing 10. To open door 12 the user pulls hand grip 14, which releases spring latch keeper 31, in a one hand maneuver. The door may also be provided with a tamperproof socket head cap screw 19. When closed, the door presses against a gasket 17.

Figure 4:
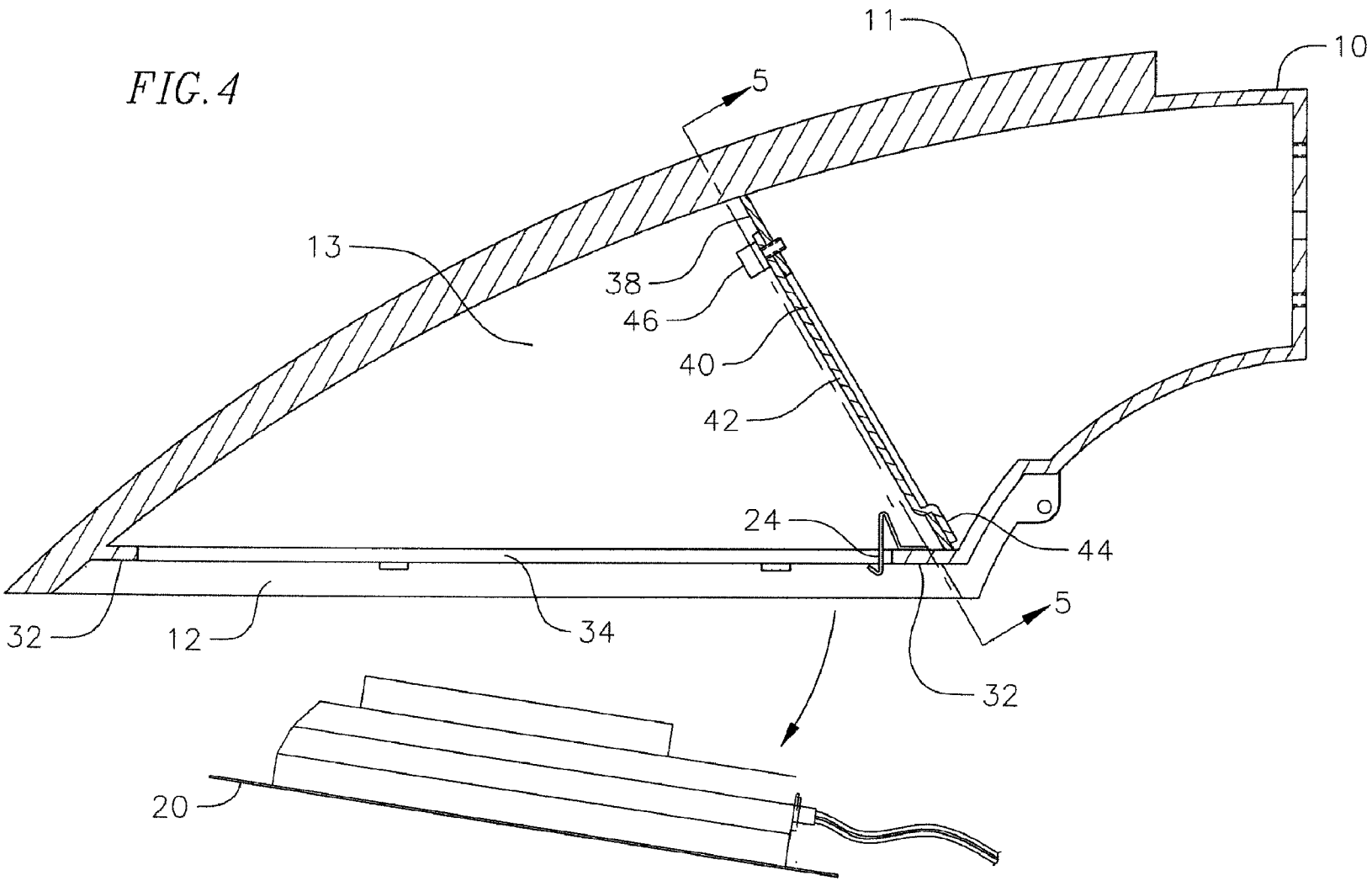
FIG. 4 is a side sectional view of the lighting fixture.

As shown in FIG. 4, the inside of housing 10 forms a cavity 13. A ledge 32 is formed around the bottom of cavity 13, leaving an opening 34. Reflector 20 is installed in the cavity 13 by tilting the back of reflector 20 down so the front of reflector 20 fits into tabs 22 as reflector 20 passes through opening 34. The back of reflector 20 is then swung up to engage spring clip 24. As a result, reflector 20 can be installed and removed without tools in a one hand maneuver.

Figure 5:
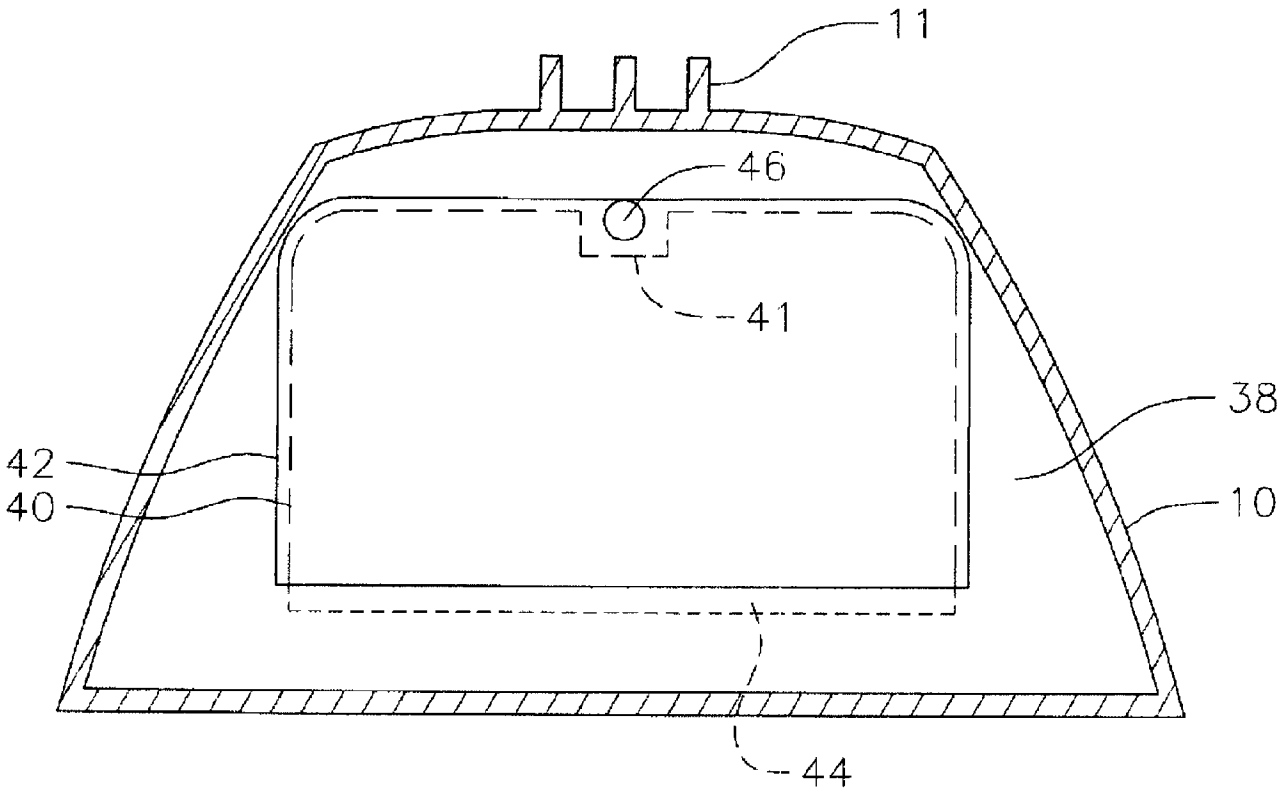
FIG. 5 is a front sectional view of the lighting fixture.
Figure 6:
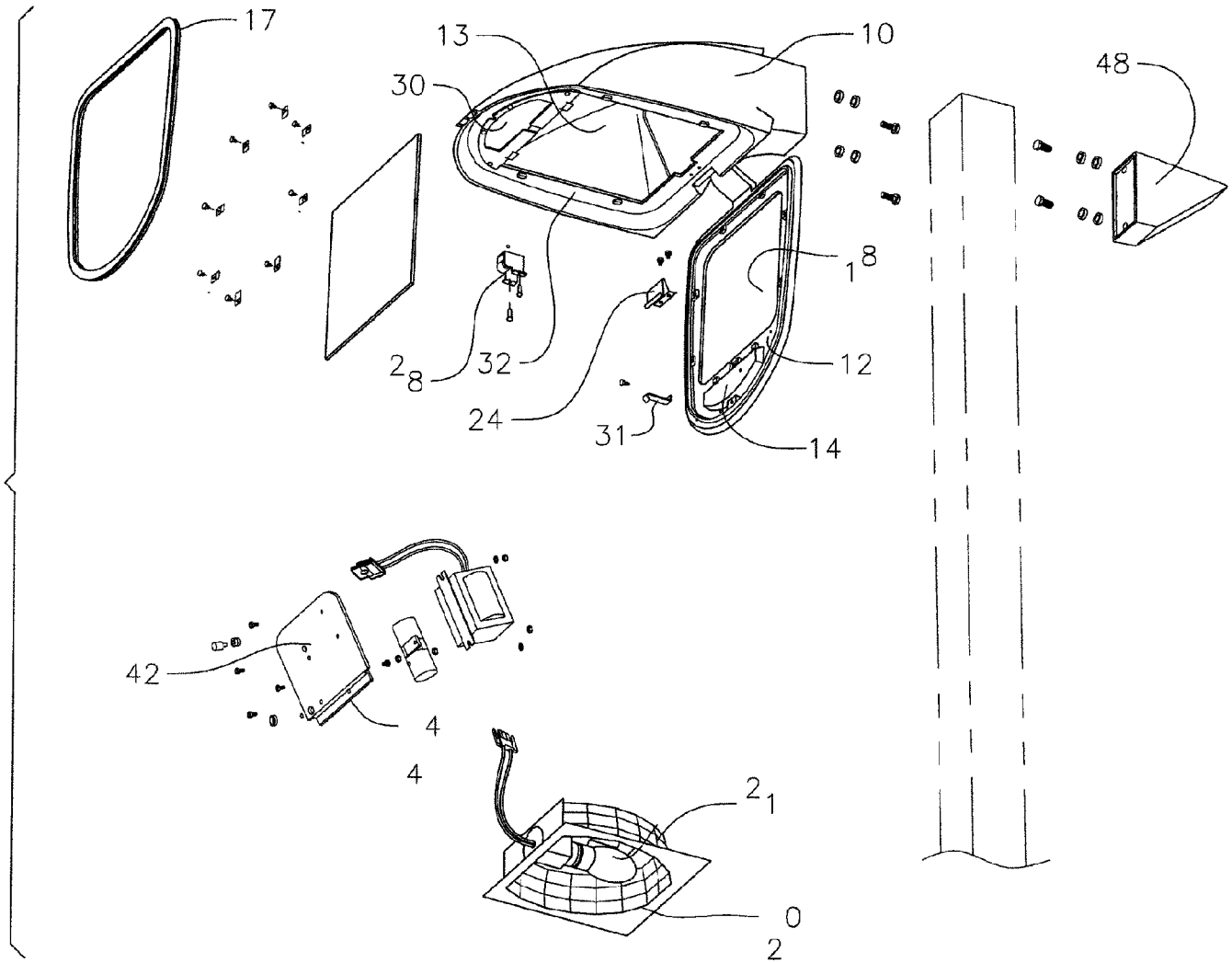
FIG. 6 is an exploded view of the top of the lighting fixture, including the pole.

As shown in FIGS. 4 and 5, a partition 38 divides cavity 13 into a lamp section and a control component section. This may facilitate heat management. An opening 40 is formed in the partition 38. A removable mounting plate 42, which carries the control components such as a ballast, capacitor, and transformer, etc., is installed inside cavity 13. Mounting plate 42 covers and overlaps the edge of opening 40 as shown in FIGS. 4 and 5. Mounting plate 42 has a bent bottom edge 44 so part of the bottom of mounting plate 42 lies on one side of partition 38 and part of it lies on the other side of partition 38. In other words, edge 44 abuts the bottom of the perimeter of opening 40. This permits the top of mounting plate 42 to swing open about the bottom thereof at edge 44 without actually attaching mounting plate 42 to partition 38. This construction in essence creates an easily releasable hinge. A tab 41 extends into opening 40. A knurled screw 46 is captured by mounting plate 42. To latch mounting plate 42 in place, a threaded opening in tab 41 is engaged by screw 46. To remove mounting plate 42, door 12 is opened, reflector 20 is removed, screw 46 is turned to release mounting plate 42, mounting plate 42 is swung open about edge 44 and then lifted out of cavity 13 through the opening 34 by grasping the knurled knob on screw 46. As best shown in FIGS. 5 and 6, edge 44 is narrower than the remainder of mounting plate 42 and narrower than opening 40 so edge 44 clears opening 40 when mounting plate 42 is lifted out of cavity 13 for servicing.

Figure 7A:
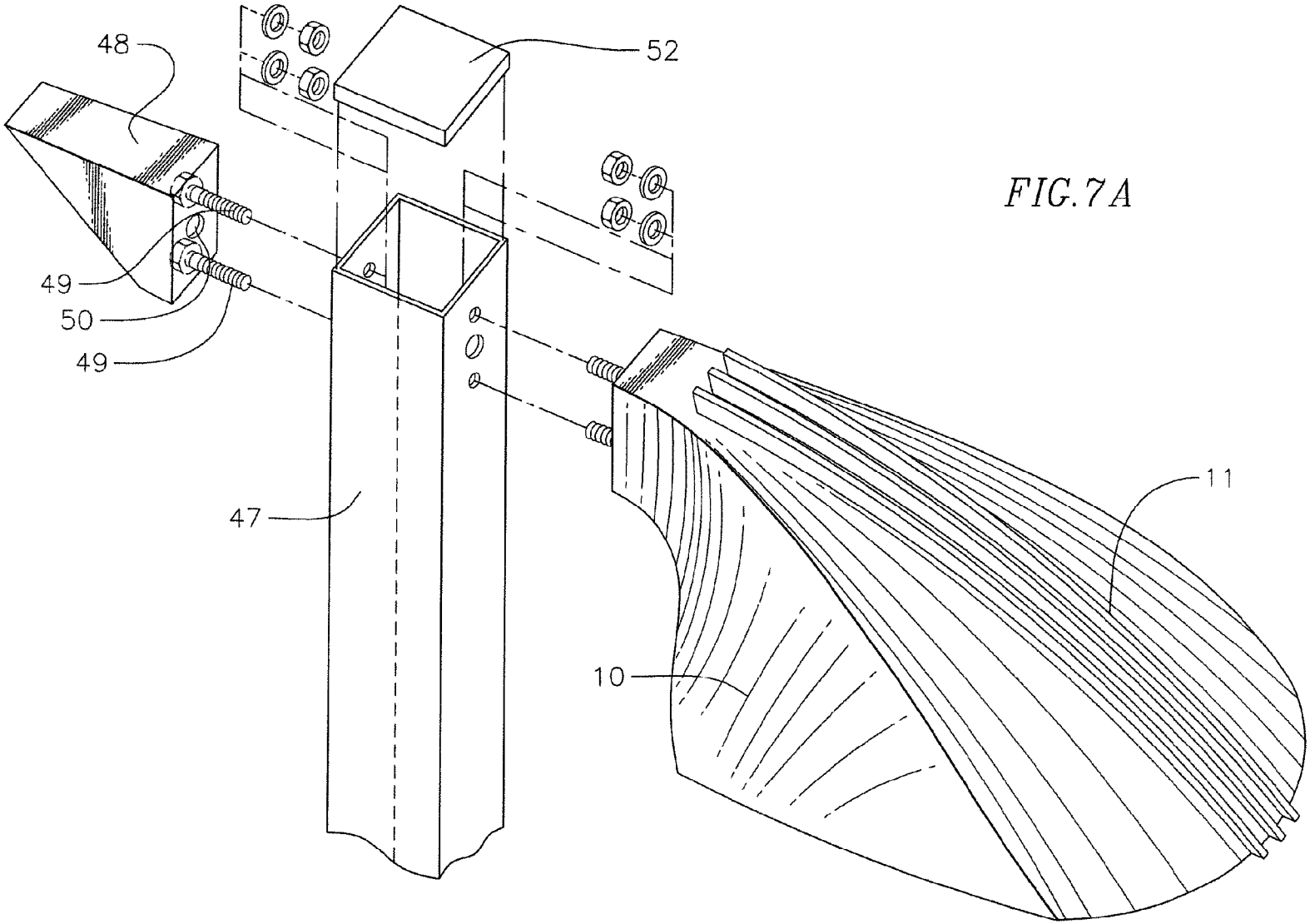
FIG. 7A is an exploded view of the top of the lighting fixture.
Figure 7B:
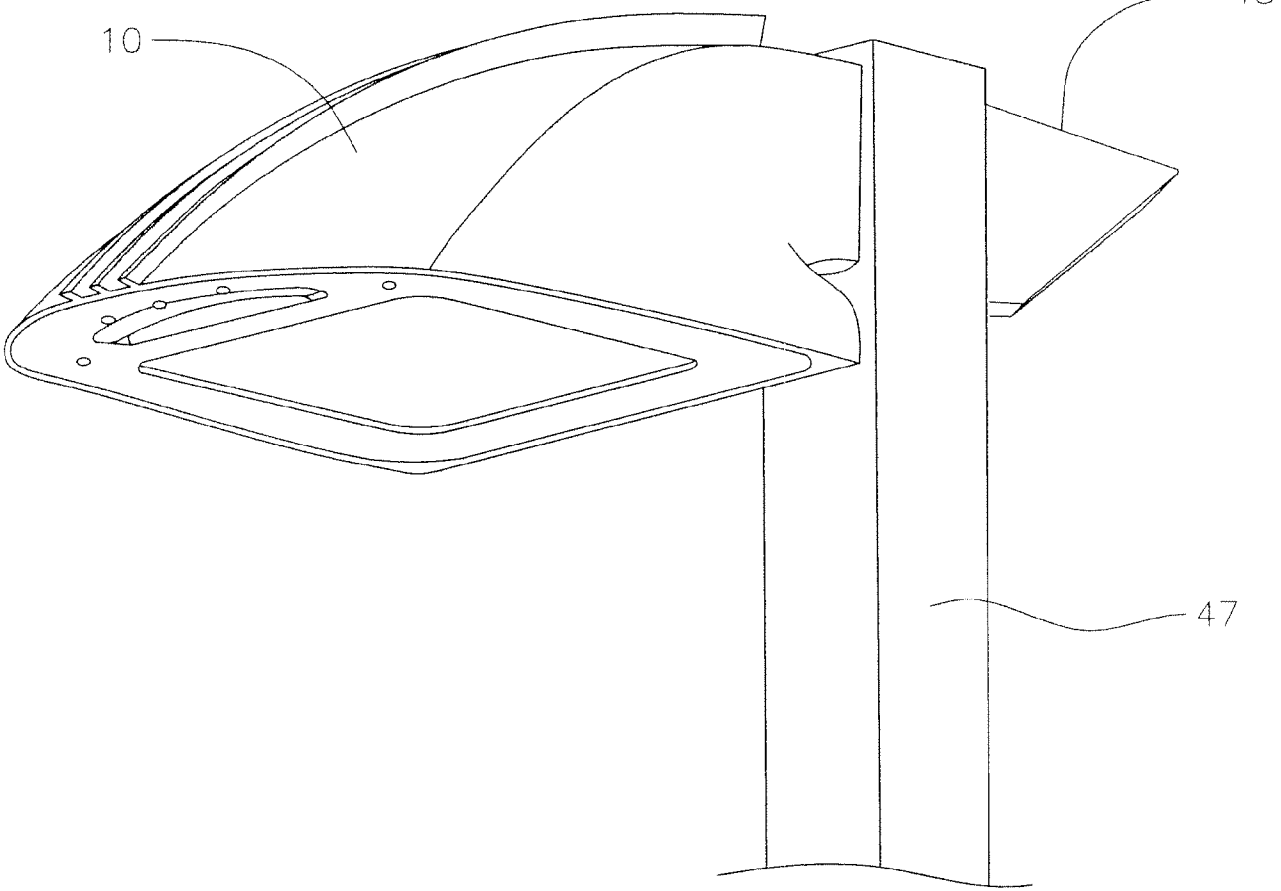
FIG. 7B is an assembled view of the top of the lighting fixture.

As shown in FIGS. 7A and 7B, housing 10 is mounted on one side of a hollow vertical pole 47 and a tailpiece 48 is mounted on the other side of pole 47. Tailpiece 48 performs a decorative, and, possibly, load balancing function. Housing 10 and tailpiece 48 have pre-installed bolts 49 and an electrical wire access hole 50. First, housing 10 is secured to pole 47 by the bolts and mating nuts. Second, tailpiece 48 is secured to pole 47 by bolts and mating nuts. Third, a pole cap 52 is installed on top of pole 47. The nuts are accessed for tightening from the open top of pole 47 before pole cap 52 is installed.

In summary the lighting fixture is designed so it can be serviced without tools and preferably by the use of one hand. Specifically, a maintenance person first swings open door 12 by deflecting spring latch keeper 31 to expose the interior of the fixture. Second, reflector 20 is removed by deflecting spring clip 24 and tilting its back down and away from housing as shown in FIG. 4. Third, screw 46 is turned to release plate 42. And finally, plate 42 is swung away from partition 38 and removed from the interior of the fixture for maintenance. The only movements required to remove plate 42 are lifting and turning, which ordinarily can be accomplished without tools with one hand by gripping the knob on screw 46.

The invention also contemplates use of fewer than all the described features that make toolless one hand maneuvers possible.

What is claimed is:

1. A lighting fixture comprising:

a housing having a component storage cavity and a first opening;

a door at the first opening;

a window in the door for transmission of light from the housing;

a removable lamp reflector inside the housing behind the window;

a partition that divides the component storage cavity into two sections;

a second opening through the partition between the sections; and a removable mounting plate dimensioned to cover the second opening, the mounting plate having an offset edge, wherein at least one control component is mounted on the mounting plate, wherein the mounting plate contacts one side of the partition at the second opening and the offset edge contacts the other side of the partition at the second opening such that the mounting plate is releasably hinged to the partition along the offset edge.

2. The lighting fixture of claim 1, in which the door is hinged at one end and latched at the other end.

3. The lighting fixture of claim 2, in which the door is latched by a spring clip.

4. The lighting fixture of claim 1, in which the offset edge of the mounting plate is bent so one part of it lies on one side of the partition and another part lies on the other side of the partition.

5. The lighting fixture of claim 4, in which the mounting plate is secured to the partition by a fastener.

6. The lighting fixture of claim 5, in which the fastener has a knob suitable for gripping and removing the mounting plate from the housing.

7. The lighting fixture of claim 1, in which one of the two sections functions as a lamp section and the other one of the two sections functions as a control component section.

8. The lighting fixture of claim 7, in which the lamp reflector is located in the light section.

9. The lighting fixture of claim 1, in which the offset edge at the bottom of the mounting plate overlaps the bottom edge of the opening, the offset edge of the mounting plate is bent so one part of it lies on one side of the partition and another part lies on the other side of the partition, and the offset edge of the mounting plate, when unrestrained, is free to swing toward the door and slide upwardly.

10. The lighting fixture of claim 1, in which the offset edge at the bottom of the mounting plate overlaps the bottom edge of the opening, the offset edge of the mounting plate is bent so one part of it lies on one side of the partition and another part lies on the other side of the partition, and the offset edge of the mounting plate is narrower than opening.

11. A method of servicing a light fixture comprising a housing having a component storage cavity and a first opening;

a door at the first opening;

a window in the door for transmission of light from the housing;

a removable lamp reflector inside the housing behind the window;

a partition that divides the component storage cavity into two sections;

a second opening through the partition between the sections; and a removable mounting plate dimensioned to cover the second opening, the mounting plate having an offset edge, wherein at least one control component is mounted on the mounting plate, wherein the mounting plate contacts one side of the partition at the second opening and the offset edge contacts the other side of the partition at the second opening such that the mounting plate is releasably hinged to the partition along the offset edge, the method comprising:

opening the door;

removing the lamp reflector from the cavity;

loosening the fastener;

swinging the mounting plate toward the door;

sliding the mounting plate toward the door; and removing the mounting plate from the cavity.

12. The method of claim 11, in which at least one of the steps is performed one-handed and without tools.

13. The method of claim 11, in which all of the steps are performed with one-handed and without tools.

14. A lighting fixture comprising:

a housing having a component storage cavity and a first opening;

a door at the first opening;

a window in the door for transmission of light from the housing;

a removable lamp reflector inside the housing behind the window a partition that divides the component storage cavity into two sections;

a second opening through the partition between the sections;

a removable mounting plate dimensioned to cover the second opening, wherein at least one control component is mounted on the mounting plate, wherein the mounting plate has an offset edge to provide a releasable hinge with the partition, and wherein the mounting plate is inside the storage cavity and accessible via the first opening.

15. The lighting fixture of claim 14, in which the mounting plate is removable from the component storage cavity.

16. The lighting fixture of claim 14 further comprising at least one protrusion configured to guide the lamp reflector into a correct position within the housing during installation of the lamp reflector, wherein the at least one protrusion is configured to retain the lamp reflector laterally within the housing after installation of the lamp reflector.

17. The lighting fixture of claim 14 further comprising a handgrip suitable for opening and closing the door.

18. The lighting fixture of claim 14 further comprising a basket positioned between the door and the housing.

19. The lighting fixture of claim 14, in which the door is configured to be opened with one hand and without tools.

20. The lighting fixture of claim 14, in which at least one of the lamp reflector and the mounting plate is configured to be opened with one hand and without tools.

* * * * *

UNITED STATES PATENT AND TRADEMARK OFFICE

CERTIFICATE OF CORRECTION

PATENT NO. : 7,866,854 B2
APPLICATION NO. : 12/113123
DATED : January 11, 2011
INVENTOR(S) : William Orellana et al.

It is certified that error appears in the above-identified patent and that said Letters Patent is hereby corrected as shown below:

| | |
|---|---|
| Column 3, Claim 10, line 60 | After "than" Insert -- the -- |
| Column 4, Claim 13, line 26 | Delete "with" |

Signed and Sealed this
Thirteenth Day of September, 2011

David J. Kappos

David J. Kappos
*Director of the United States Patent and Trademark Office*